US009254652B2

(12) United States Patent
Yazaki

(10) Patent No.: US 9,254,652 B2
(45) Date of Patent: Feb. 9, 2016

(54) LIQUID EJECTING HEAD AND LIQUID EJECTING APPARATUS

(71) Applicant: SEIKO EPSON CORPORATION, Tokyo (JP)

(72) Inventor: Shiro Yazaki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/204,515

(22) Filed: Mar. 11, 2014

(65) Prior Publication Data

US 2014/0292949 A1 Oct. 2, 2014

(30) Foreign Application Priority Data

Mar. 26, 2013 (JP) ..... 2013-063726

(51) Int. Cl.
*B41J 2/045* (2006.01)
*B41J 2/14* (2006.01)

(52) U.S. Cl.
CPC ..... *B41J 2/14201* (2013.01); *B41J 2/14233* (2013.01); *B41J 2002/14491* (2013.01)

(58) Field of Classification Search
None
See application file for complete search history.

(56) References Cited

U.S. PATENT DOCUMENTS

| | | | | |
|---|---|---|---|---|
| 2003/0156165 | A1 | 8/2003 | Sakaida | |
| 2005/0162483 | A1 * | 7/2005 | Katayama | 347/65 |
| 2008/0012907 | A1 | 1/2008 | Takahashi | |
| 2008/0062230 | A1 | 3/2008 | Nozu et al. | |
| 2009/0244206 | A1 | 10/2009 | Nakayama | |
| 2011/0102519 | A1 * | 5/2011 | Koseki | 347/71 |

FOREIGN PATENT DOCUMENTS

JP 2003-311954 11/2003

OTHER PUBLICATIONS

European Search Report for Application No. 14161264.8 dated Oct. 24, 2014.

* cited by examiner

*Primary Examiner* — Erica Lin
(74) *Attorney, Agent, or Firm* — Workman Nydegger

(57) ABSTRACT

A piezoelectric layer is integrally formed in such a way that opening portions of a plurality of pressure chambers in a flow channel forming member are covered. In a region that corresponds to a position between adjacent pressure chambers in the piezoelectric layer, a hollow that penetrates the piezoelectric layer or that has a relatively thin thickness in the piezoelectric layer is formed along the sides of the opening of each of the pressure chambers. The hollow is formed to avoid a region along a corner of the pressure chamber in the region.

12 Claims, 7 Drawing Sheets

LIQUID EJECTING HEAD AND LIQUID EJECTING APPARATUS

This application claims the benefit of Japanese Application 2013-063726 filed on Mar. 26, 2013. The foregoing application is incorporated by reference in its entirety.

BACKGROUND

1. Technical Field

Embodiments of the present invention relate to a liquid ejecting head that ejects liquid by driving piezoelectric elements and a liquid ejecting apparatus including the piezoelectric elements. More particularly, embodiments of the invention relate to a liquid ejecting head capable of preventing configuration members from being damaged due to stress generated when the piezoelectric elements are driven, and to a liquid ejecting apparatus.

2. Related Art

A liquid ejecting apparatus is an apparatus that includes a liquid ejecting head and that ejects various types of liquid from the liquid ejecting head. Image recording apparatuses such as ink jet type printers or ink jet type plotters are examples of liquid ejected apparatuses. In recent years, a liquid ejecting apparatus is used in various types of manufacturing apparatuses because the liquid ejecting apparatus can accurately place an extremely small amount of liquid in a predetermined position. For example, a liquid ejecting apparatus is used in a display manufacturing apparatus that is used to manufacture color filters of a liquid crystal display or the like, in an electrode forming apparatus that is used to form electrodes of an organic Electro Luminescence (EL) display, a Field Emission Display (FED), or the like, and in a chip manufacturing apparatus that is used to a manufacture biochip. Further, liquefied ink is ejected from a recording head for the image recording apparatus, and solutions of respective color materials, that are, R (Red), G (Green), and B (Blue) are ejected from a color material ejecting head for the display manufacturing apparatus. In addition, liquefied electrode material is ejected from an electrode material ejecting head for the electrode forming apparatus, and a bio organic substance solution is ejected from a bio organic substance ejecting head for the chip manufacturing apparatus.

The liquid ejecting head is configured to introduce liquid into pressure chambers, generate a change in pressure of the liquid in the pressure chambers, and eject the liquid from nozzles that communicate with the pressure chambers. The pressure chambers are formed in a silicon crystalline substrate (hereinafter, referred to as a pressure chamber forming substrate) by anisotropic etching with excellent dimensional accuracy. In addition, piezoelectric elements are used as a pressure generation section. The pressure generation section generates change in the pressure of the liquid in the pressure chambers.

There are various configurations of such a piezoelectric element. For example, a piezoelectric element may be configured in such a way that a lower electrode is located on a close side to the pressure chamber. A piezoelectric layer that is formed of a piezoelectric material, such as lead zirconate titanate (PZT), and an upper electrode are respectively laminated and patterned on the lower electrode using a film formation technology. Further, one of the upper and lower electrodes functions as an individual electrode that is provided for each pressure chamber, and a remaining one of the upper and lower electrodes functions as a common electrode that is common to a plurality of pressure chambers. With regard to the piezoelectric film, a portion of the piezoelectric film that is interposed between the upper and lower electrodes is an active portion. The active portion deforms due to the supply of a voltage to the electrodes. A portion that is separated from one or both of the upper and lower electrodes is an inactive portion that does not deform due to the supply of the voltage to the electrodes.

A configuration of the liquid ejecting head is proposed in which a piezoelectric layer is formed in a series in a state in which openings of a plurality of pressure chambers are covered on a pressure chamber forming substrate (for example, refer to JP-A-2003-311954). That is, one piezoelectric layer is provided that is common to the plurality of pressure chambers. A portion of the piezoelectric layer, which is interposed between upper and lower electrodes, functions as an active portion (activated layer). An active portion corresponds to each pressure chamber. In this configuration, when a predetermined active portion is deformed, an unnecessary portion (e.g., an active portion that corresponds to neighboring pressure chambers) is also deformed. Thus, there is a problem in that so-called adjacent crosstalk is generated. In JP-A-2003-311954, grooves, which are formed by partially removing the piezoelectric layer, are provided to surround the peripheries of the openings of the pressure chamber. The grooves can prevent or reduce stress, generated when a predetermined active portion is deformed, from being transferred to adjacent active portions. Thus it is possible to reduce the so-called crosstalk.

However, in the related-art configuration, stress is concentrated on corners of an opening portion of a pressure chamber that has a polygonal shape. More specifically, stress may be generated on sharp corners in accordance with the deformation of the active portion, and thus there is a problem in that damage, such as cracks, may occur in a pressure chamber forming substrate that is configured from a silicon substrate or in a head configuration member, such as a piezoelectric layer.

SUMMARY

An advantage of some aspects of embodiments of the invention is to provide a liquid ejecting head and a liquid ejecting apparatus that are capable of preventing configuration members from being damaged by reducing stress concentration when piezoelectric elements are driven.

In one embodiment, a liquid ejecting head includes a pressure chamber forming member that is formed with pressure chambers that communicate with nozzles, and a piezoelectric element that includes a first electrode, a piezoelectric layer, and a second electrode. The first electrode, the piezoelectric layer, and the second electrode are laminated in a position corresponding to an opening portion of each of the pressure chambers in the pressure chamber forming member in a sequence from a side close to the opening portion. The opening portion of each of the pressure chambers has a polygonal shape that has a plurality of corners and sides that connect the corners to each other. The piezoelectric layer may be integrally formed throughout the plurality of pressure chambers in the pressure chamber forming member. A predetermined region along the sides from among regions that are interposed between adjacent pressure chambers includes a hollow that penetrates the piezoelectric layer or a hollow that has a relatively thin thickness in the piezoelectric layer. A predetermined region along the corners is relatively thicker than the thickness of the piezoelectric layer in the hollow.

The positional relationship between each of the pressure chambers (pressure chamber forming member) and the piezoelectric layer includes a configuration that is in a laminating relation in a state in which another member, such as the vibration plate, is interposed therebetween. In addition, "correspond" indicates that each of the members is in a positional relationship which overlaps with each other when viewed from a laminating direction.

In addition, according to another aspect of an embodiment of the invention, a liquid ejecting head includes a pressure chamber forming member that is formed with pressure chambers that communicate with nozzles, and a piezoelectric element that includes a first electrode, a piezoelectric layer, and a second electrode, which are laminated in a position corresponding to an opening portion of each of the pressure chambers in the pressure chamber forming member in a sequence from a side close to the opening portion. The opening portion of each of the pressure chambers has a polygonal shape that has a plurality of corners and sides that connect the corners to each other. The piezoelectric layer is integrally formed throughout the plurality of pressure chambers in the pressure chamber forming member. A region that is interposed between sides from among regions which are interposed between adjacent pressure chambers has a hollow that penetrates the piezoelectric layer or a hollow that has a relatively thin thickness in the piezoelectric layer. A region, that is interposed in such a way that the corners are positioned on at least one side, is relatively thicker than the thickness of the piezoelectric layer in the hollow.

In the liquid ejecting head, in a region along the sides of the adjacent pressure chambers in the piezoelectric layer, a hollow is formed along the sides. The region along the corners on which the stress of the pressure chambers is easily concentrated, that is, the region which is interposed in such a way that the corner of at least one side of the opening portion is positioned is covered by the piezoelectric layer that is relatively thicker than the thickness of the piezoelectric layer in the hollow. Therefore, stress, generated when the active portion of the piezoelectric element is driven, hardly concentrates on the corners of the pressure chambers. As a result, it is possible to suppress the damage of a configuration member, such as the pressure chamber forming member or the piezoelectric element. In particular, in a case of a sharp corner, although stress is easily concentrated on the corner, embodiments of the invention are suitable for such a configuration and can reduce damage that may occur from stress that may concentrate on the sharp corner.

In the liquid ejecting head, in a position that is a region interposed between adjacent hollows and that corresponds to the opening portion of each of the pressure chambers, the piezoelectric layer that is thicker than the piezoelectric layer in the hollows may be provided, and a width of the piezoelectric layer in the position in a direction in which the pressure chambers may be disposed in parallel is narrower than a width of the opening portion of each of the pressure chambers in the same direction.

In the liquid ejecting head, the piezoelectric layer that is provided in a position corresponding to the opening portion of each of the pressure chambers is easily moved. Thus it is possible to effectively apply pressure variation with respect to liquid in the pressure chambers.

In addition, on the piezoelectric layer that is positioned on both sides of the opening portion of each of the pressure chambers in a direction intersecting a direction in which the pressure chambers are disposed in parallel and that covers at least one corner, a laminated material that causes a total thickness of the portion to be relatively thicker than other portions may be provided.

In the liquid ejecting head, the laminated material, which causes the total thickness of the portion to be relatively thicker than other portions, is provided on the piezoelectric layer that is positioned on both sides of the opening portion of each of the pressure chambers in a direction intersecting a direction in which the pressure chambers are disposed in parallel and which covers at least one corner. As a result, the laminated material limits the displacement of both end portions of the piezoelectric element, and it is possible to suppress the irregular displacement of the piezoelectric element when the piezoelectric element is driven.

In addition, in the liquid ejecting head, the laminated material may be a metal film, and may be formed in a series along a first direction in order to electrically conduct to the second electrode of the plurality of piezoelectric elements.

In the liquid ejecting head, the laminated material may be a metal film, and is electrically conducted to the second electrode of a plurality of piezoelectric elements that are formed in a series along the first direction. Thus it is possible to increase a current capacity of the second electrode that is provided to be common to each of the piezoelectric elements.

In addition, the liquid ejecting head may further include a sealing member that includes an empty portion therein. The empty portion of the sealing member is capable of receiving an active portion in which the first electrode, the piezoelectric layer, and the second electrode are superimposed on each other. The sealing member may be bonded to the laminated material in a state in which the active portion is received in the empty portion.

In the liquid ejecting head, the sealing member is bonded to the portion that has the total thickness which is relatively thick by providing the laminated material. As a result, it is possible to further suppress the deformation of the piezoelectric element other than the active portion, and it is possible to further securely suppress the generation of damage, such as cracks, of the configuration member, such as the pressure chamber forming member or the piezoelectric element. In addition, a hollow may not be provided on a portion to which the sealing member is bonded and the piezoelectric layer of the portion may have a flat surface. Thus it is possible to bond the sealing member in a stable state.

Further, according to another aspect of embodiments of the invention, a liquid ejecting apparatus that includes the liquid ejecting head which has any of the above configurations is disclosed.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. In embodiments that are described below, various limitations are applied as examples of the invention. However, the scope of embodiments of the invention is not limited to the embodiments if the embodiments of the invention are not particularly limited in the description below. In addition, in the description below, an ink jet type printer (hereinafter, a printer), on which an ink jet type recording head (hereinafter, a recording head) that is a type of a liquid ejecting head is mounted, is exemplified as an example of a liquid ejecting apparatus.

Figure 1:
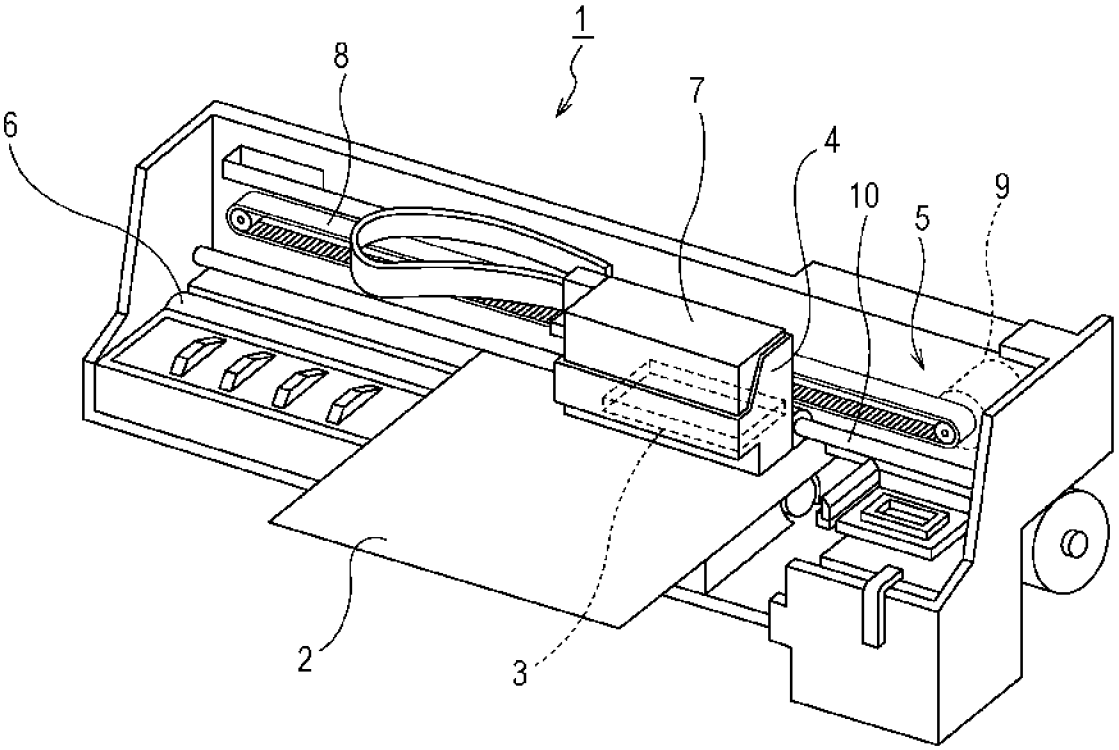
FIG. 1 is a perspective view illustrating an example configuration of a printer.

The configuration of a printer 1 will be described with reference to FIG. 1. The printer 1 is an apparatus that records an image or the like by ejecting liquefied ink (an example of a liquid) onto the surface of a recording medium 2 (a kind of an impact target) such as recording paper. The printer 1 includes a recording head 3, a carriage 4 to which the recording head 3 is attached, a carriage moving mechanism 5 that moves the carriage 4 in a main scan direction, and a transport mechanism 6 which transports the recording medium 2 in a sub scan direction. Here, the ink is a kind of liquid and is stored in the ink cartridge 7 as a liquid supply source. The ink cartridge 7 is detachably mounted on the recording head 3. The printer 1 may be configured such that the ink cartridge 7 is arranged on a main body side of the printer 1, and the ink is supplied to the recording head 3 from the ink cartridge 7 through an ink supply tube.

The carriage moving mechanism 5 includes a timing belt 8. Further, the timing belt 8 is driven by a pulse motor 9 such as a DC motor. Therefore, when the pulse motor 9 operates, the carriage 4 is guided through a guide rod 10 which is installed in the printer 1 and the carriage 4 reciprocates in the main scan direction (in the width direction of the recording medium 2).

Figure 2:
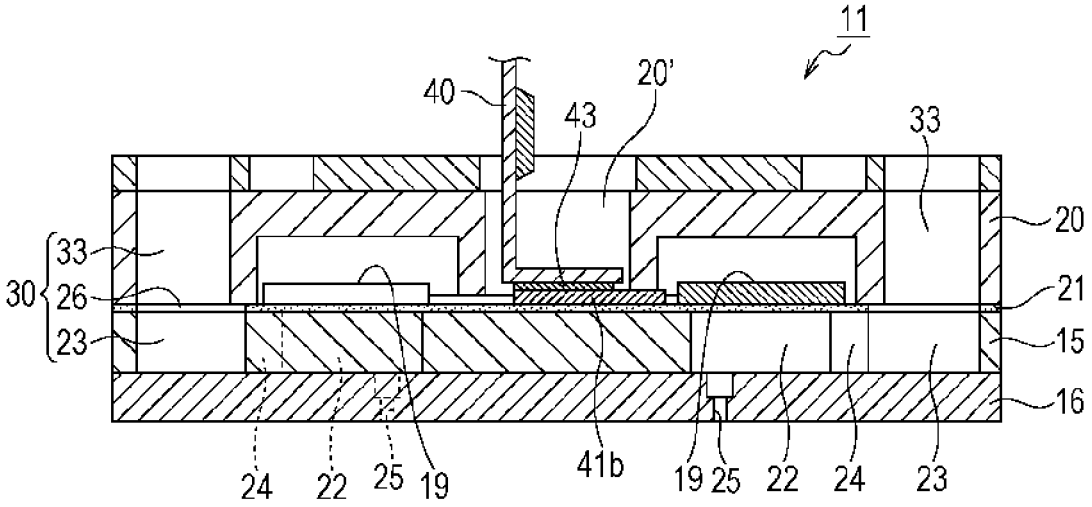
FIG. 2 is a cross-sectional view illustrating an example of a head unit.
Figure 3:
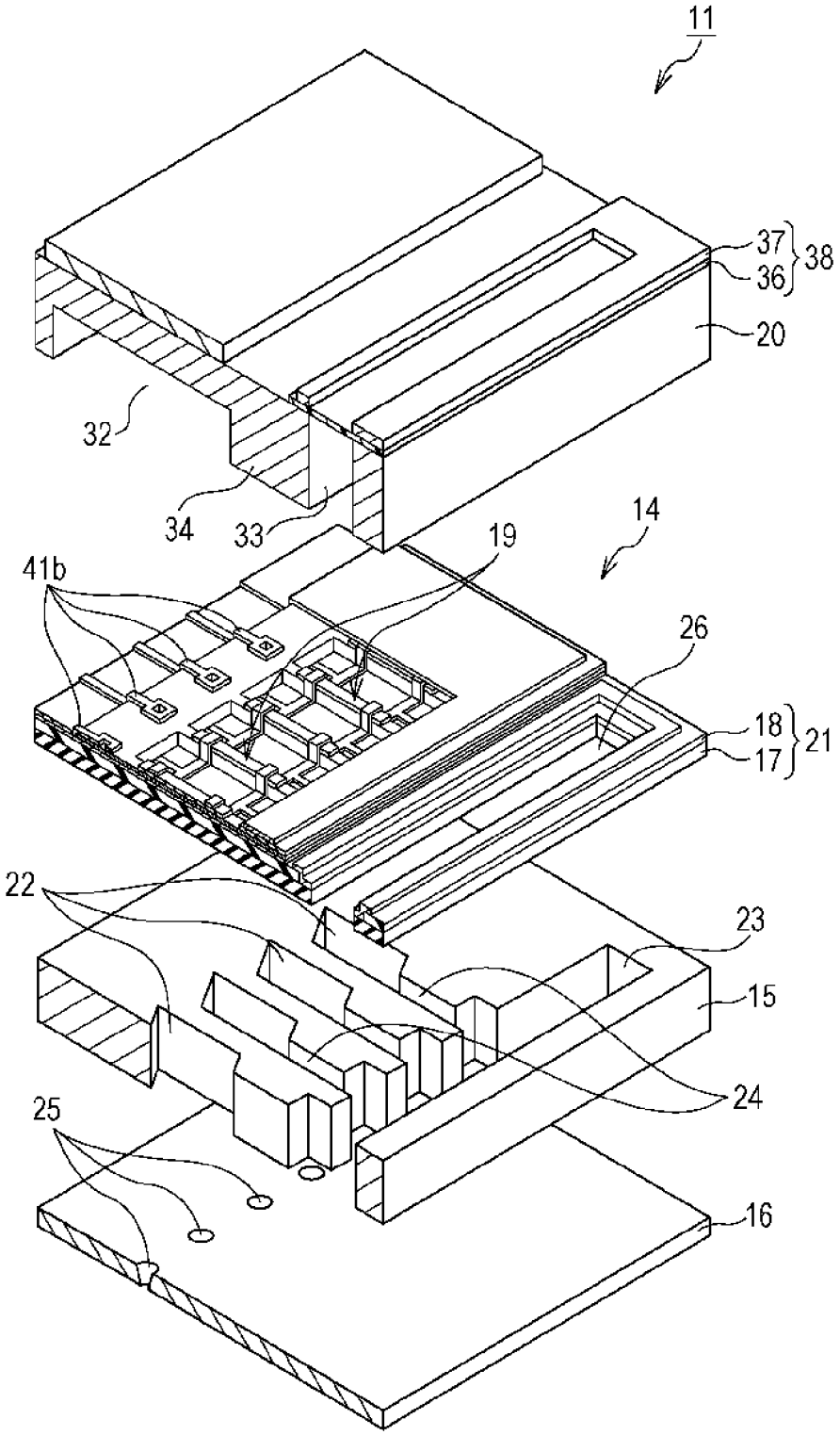
FIG. 3 is an exploded perspective view illustrating the head unit.
Figure 4:
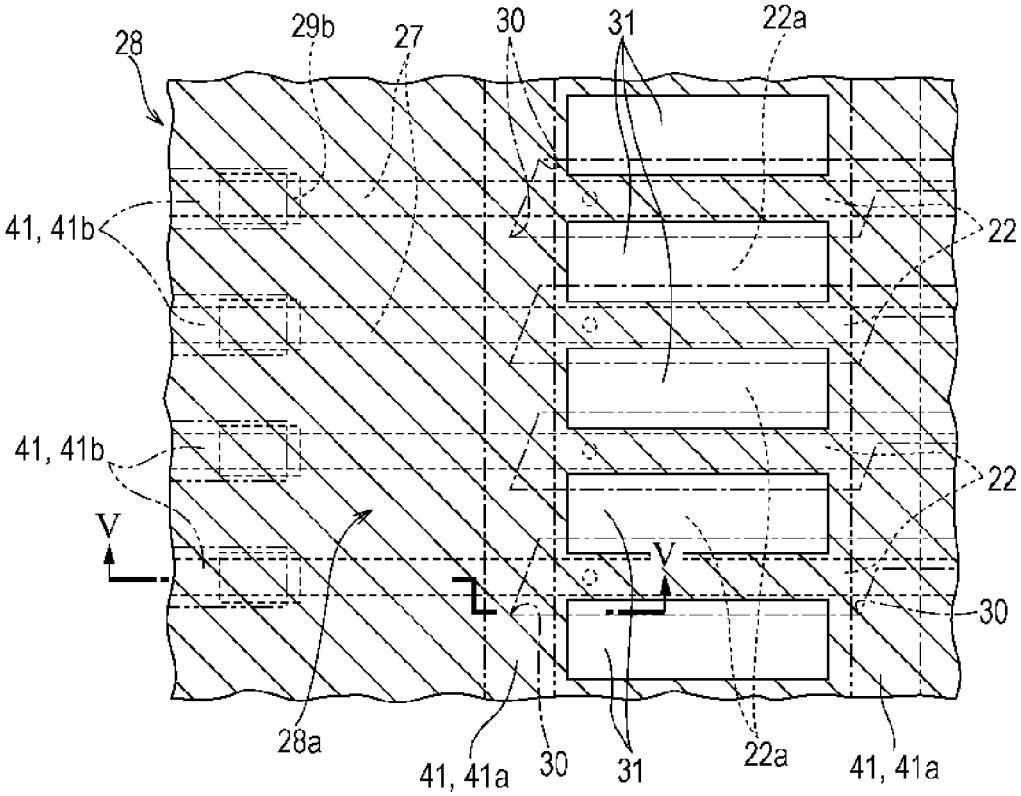
FIG. 4 is a plan view illustrating an example of a piezoelectric layer.
Figure 5:
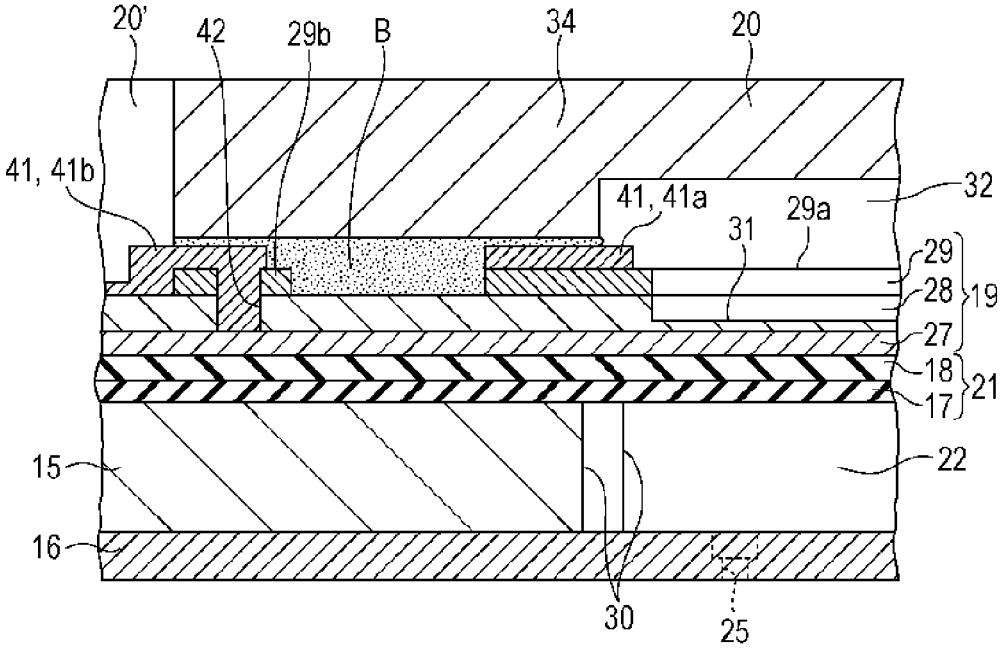
FIG. 5 is a cross-sectional view illustrating the head unit taken along a line V-V in FIG. 4.

FIG. 2 is a cross-sectional view illustrating an inside configuration of a head unit 11 which is included in the recording head 3. FIG. 3 is an exploded perspective view illustrating the head unit 11. In addition, FIG. 4 is a top view illustrating a piezoelectric layer 28 in piezoelectric elements 19. FIG. 5 is a cross-sectional view illustrating the head unit 11 taken along a line V-V in FIG. 4. Meanwhile, each drawing following FIG. 3 partially illustrates a configuration corresponding to one of a total of two rows of nozzles (right side in FIG. 2) that are provided in the head unit 11.

The head unit 11 is configured by laminating a flow channel forming substrate 15 (a kind of a pressure chamber forming member), a nozzle plate 16, an actuator unit 14, a sealing board 20 (a kind of sealing member), and the like.

The flow channel forming substrate 15 may be a plate material that includes a silicon single crystal substrate in which orientation of the surface is (110) in one embodiment. In the flow channel forming substrate 15, a plurality of pressure chambers 22 are formed by anisotropic etching and are arranged in a nozzle row direction. The pressure chambers 22 are empty portions which are long in a direction intersecting a direction in which the pressure chambers are disposed in parallel. Division is performed on the pressure chambers 22 in one embodiment by two (111) surfaces that are perpendicular to the (110) surface of the flow channel forming substrate 15 by the anisotropic etching. The two (111) surfaces intersect each other at a predetermined angle. Therefore, the opening shapes of the pressure chambers 22 when viewed from a direction that is perpendicular to the flow channel forming substrate 15 (a direction in which the head unit configuration members are laminated) are approximately polygonal shapes. More specifically, the pressure chambers 22, when viewed in this direction, have approximately parallelogram shapes (an example is illustrated in FIG. 3).

Each of the pressure chambers 22 corresponds to one of the nozzles 25 in the nozzle plate 16. There may be a one to one correspondence between the pressure chambers 22 and the nozzles 25. In one example, the pitch of forming each of the pressure chambers 22 corresponds to the pitch of forming the nozzles 25. In addition, as shown in the flow channel forming substrate 15 illustrated in FIG. 2, communication portions 23 that pass through the flow channel forming substrate 15 are formed in a series along the direction in which the pressure chambers 22 are disposed. The communication portions 23 are formed in regions that are separated from the pressure chambers 22 on the sides of the pressure chambers in the longitudinal direction pressure chambers (opposite sides to the sides which communicate with the nozzles). The communication portions 23 are empty portions that are common to the respective pressure chambers 22. The communication portions 23 communicate with the respective pressure chambers 22 through ink supply paths 24.

The communication portions 23 also communicate with the communication opening portions 26 of the vibration plate (described later) and the empty liquid chamber portions 33 of the sealing board 20, and configure reservoirs (common liquid chambers) which are ink chambers common to the respective pressure chambers 22. Each ink supply path 24 is formed with a width that is narrower than the width of each pressure chamber 22, and each ink supply path 24 corresponds to a portion that becomes or provides a passage resistance of ink that flows from the communication portion 23 into the pressure chamber 22. The ink supply path 24 provides a flow resistance.

The nozzle plate 16 is bonded to the lower surface (surface that is opposite to a surface to which the actuator unit 14 is bonded) of the flow channel forming substrate 15 through an adhesive, a thermal welding film, or the like. The nozzle plate 16 may be a plate in which the plurality of nozzles 25 are established in row shapes with a predetermined pitch. In one embodiment, 360 nozzles 25 are arranged in a row with a pitch corresponding to 360 dpi. Thus a nozzle row (a kind of a nozzle group) is configured. Each of the nozzles 25 communicates with one of the pressure chambers 22 at an end portion on a side that is opposite to each of the ink supply paths 24. The nozzle plate 16 may be configured from, for example, a glass ceramics, a silicon single crystal substrate, stainless steel, or the like. A total of two nozzle rows are provided in the head unit 11 in one embodiment, and liquid flow channels corresponding to the respective nozzle rows are provided to be symmetrical while interposing the sides of the nozzles 25.

The actuator unit 14 in one embodiment is configured to include a vibration plate 21, piezoelectric elements 19, and metal layers 41. The vibration plate 21 includes an elastic film 17 that is formed on the upper surface of the flow channel forming substrate 15 and is formed of a silicon oxide ($SiO_2$), and an insulation film 18 that is formed on the elastic film 17 and is formed of zirconium oxide ($ZrO_2$). The portions of the vibration plate 21 that correspond to the pressure chambers 22 (the portions that cover the upper openings of the pressure chambers 22) are displaced in a direction that is away from the nozzles 25 or that is closer to the nozzles 25 in accordance with the bending deformation of the piezoelectric elements 19. The communication opening portion 26 that communicates with the communication portion 23 is provided in a portion corresponding to the communication portion 23 of the flow channel forming substrate 15 in the vibration plate 21. It is possible to use a configuration that causes a part of the flow channel forming substrate 15 to function as the elastic film of the vibration plate 21 by processing the part to be thin.

The piezoelectric elements 19 are formed at portions of the insulation film 18 of the vibration plate 21 that correspond to the pressure chambers 22. Each of the piezoelectric elements 19 may be configured by sequentially laminating a lower electrode 27 (corresponding to a first electrode), a piezoelectric layer 28, and an upper electrode 29 (corresponding to a second electrode) from the side of the vibration plate 21. The lower electrode 27 is patterned in a long narrow strip form for each pressure chamber 22, and becomes an individual electrode for an active portion of each of the piezoelectric elements 19. In addition, the upper electrode 29 is an electrode that is common to each of the piezoelectric elements 19 in the same row and is formed in a series along the direction in which each of the piezoelectric elements is disposed. The dimension of a direction of the upper electrode 29 (the longitudinal direction of the pressure chamber) that is perpendicular to the direction in which the piezoelectric elements are disposed is set to be slightly larger than the dimension of the opening sections of the pressure chambers 22 in the same direction. Further, in a direction in which the configuration members of each of the piezoelectric elements 19 are laminated, a portion in which the upper electrode 29, the piezoelectric layer 28, and the lower electrode 27 overlap with each other is the active portion in which piezoelectric deformation is generated when a voltage is supplied to both the electrodes. That is, the upper electrode 29 is the common electrode of the piezoelectric element 19, and the lower electrode 27 is the individual electrode of the piezoelectric element 19. The upper electrode 29 and the lower electrode 27 can be configured to be reversed according to the circumstance of a driving circuit or a wiring.

The piezoelectric layer 28 is formed on the vibration plate 21 so as to cover the entire surface of the lower electrode 27. It is possible to use a substance that includes lead (Pb), titanium (Ti), and zirconium (Zr), for example, a ferroelectric piezoelectric material, such as lead zirconate titanate (PZT), or a substance acquired by adding metallic oxide, such as niobium oxide, nickel oxide, or magnesium, thereto as the piezoelectric layer 28. As shown in FIG. 4, hollows 31 are formed in portions corresponding to regions interposed between adjacent pressure chambers 22 in the piezoelectric layer 28. In one example, portions corresponding to walls 22*a* (refer to FIG. 4) perform division between or separate neighboring pressure chambers 22. The hollows 31 are configured from depressions or through holes that are formed by partially removing the piezoelectric layer 28. In one example, the hollows 31 extend along the sides (opening edges) of the pressure chambers 22. In conclusion, the hollows 31 are portions which have a relatively thinner thickness than other portions of the piezoelectric layer 28 or are portions which pass through the piezoelectric layer 28.

In one example, the dimensions of the hollows 31 in the longitudinal direction are set to be shorter than the dimensions of the opening portions of the pressure chambers 22 in the longitudinal direction. The hollows 31 may be formed in regions along the sides of the openings of the pressure chambers 22 in regions interposed between the adjacent pressure chambers 22. In other words, the hollows 31 are formed in portions that are regions interposed between adjacent pressure chambers 22 and that are not interposed between the corners 30 (also called corner portions or corner angle portions) of the pressure chambers 22. The hollows 31 may be located in positions that are interposed between the sides of the opening portions of both pressure chambers 22. Meanwhile, the "sides" of each of the opening portions of the pressure chambers 22 mean edges in a substantially straight form that connect the corners 30 of the opening of the pressure chamber 22 or edges (peripheral edge portions) that connect the corners 30 and are sufficiently gently bent compared to the corners 30.

Therefore, when viewed in the direction in which the configuration members of the head unit 11 are laminated, none of the corners 30 overlap with the hollows 31 and all of the corners 30 of the opening portion of each of the pressure chambers 22 are covered by the piezoelectric layer 28. In addition, the dimension of each of the hollows 31 in the width direction (direction in which the pressure chambers are disposed in parallel) is set to be a little larger than the width of each of the walls 22*a* in one embodiment. That is, both edge portions of each of the hollows 31 in the width direction partially overlap with the opening section of each of the pressure chambers 22. On the other hand, the piezoelectric layer 28 disposed in regions along the corners 30 are relatively thicker than the piezoelectric layer 28 in the hollows 31. In other words, regions, which are interposed in such a way that the corners 30 are positioned on at least one side between the adjacent pressure chambers 22, are relatively thicker than the thickness of the piezoelectric layer 28 in the hollows 31. Further, the piezoelectric layer 28 that is thicker than the hollows 31 is provided in a beam shape in positions over the opening portions of the pressure chambers 22 in regions between the adjacent hollows 31. The width of the piezoelectric layer 28 of the portions in the direction in which the pressure chambers are disposed in parallel is slightly narrower than the widths of the opening portions of the pressure chambers 22 in the same direction. When the hollows 31 are provided on the both sides of the beam-shaped piezoelectric layer 28, it is possible to smoothly displace the piezoelectric layer 28 and it is possible to suppress unnecessary displacement of portions other than the beam-shaped piezoelectric layer 28, which is a driving target. In one embodiment, the width of the piezoelectric layer 28 that configures the active portions in the beam-shaped portions is narrower than the widths of the pressure chambers 22. Thus it is easier to move the piezoelectric layer 28 and it is possible to effectively apply pressure variation with respect to ink or liquid in the pressure chambers 22.

In one example, the active portions of the piezoelectric elements 19 are defined by portions in which the upper electrode 29, the piezoelectric layer 28, and the lower electrode 27 overlap with each other. However, in a configuration in which the hollows 31 are provided as described above, the beam-shaped piezoelectric layer 28 in ranges that are interposed between the adjacent hollows 31, and the upper and lower electrodes 27 and 29 thereof substantially function as the active portions. Further, the hollows 31 are not provided in the vicinity of the corners 30 of each of the pressure chambers 22 on which stress is easily concentrated. The corners 30 are covered by the piezoelectric layer 28.

Therefore, it is difficult for stress, generated when the active portions of the piezoelectric elements 19 are driven, to concentrate on the corners 30 of each of the pressure chambers 22. Thus it is possible to suppress the damage of the flow channel forming substrate 15 that may be formed of a silicon single crystal substrate, the vibration plate 21, or the piezoelectric elements 19. In particular, similar to the pressure chambers 22 in one embodiment, when the corners 30 are included in the end portions of each of the opening portions in the longitudinal direction and the corners 30 are sharp corners 30, stress is easily concentrated on the corners 30. However, embodiments of the invention are suitable for such a configuration. A range of forming the hollows 31 may avoid at least sharp corners 30 and the hollows 31 may overlap with dull corners 30.

The upper electrode 29 includes a main body portion 29*a* that defines the active portion, and a conductive portion 29*b* that is separated from the main body portion 29*a*. The conductive portion 29*b* is present on the piezoelectric layer 28 in a region that is separated from the opening edge of the pressure chamber 22 in the longitudinal direction of the pressure chamber and is positioned on the other nozzle row side. Further, the conductive portion 29*b* corresponds to the lower electrode 27 and is independently formed in a position that has a predetermined interval from the main body portion 29*a*. Further, as shown in FIG. 5, a through hole 42, which reaches the lower electrode 27 from the upper surface of the conductive portion 29*b* while passing through the conductive portion 29*b* and the piezoelectric layer 28, is formed.

A metal layer 41 that may be formed of gold (Au) is formed on the upper electrode 29 through an adhesion layer (for example, NiCr) that is not shown in the drawing. The metal layer 41 may be configured from weight portions 41*a* and lead electrode portions 41*b* (a kind of an element terminal portion). Each of the weight portions 41*a* is a kind of a laminated material, and is a strip-shaped member which extends along the direction in which the piezoelectric elements are arranged in rows over the plurality of piezoelectric elements 19. The weight portions 41*a* are respectively formed in both end portions of each of the upper opening portions of the pressure chambers 22 in the longitudinal direction on the main body portion 29*a* of the upper electrode 29. More specifically, in a planar view, the weight portions 41*a* are formed in positions that overlap with at least one corner 30 of each the opening portions of the pressure chambers 22. In one embodiment, the weight portions 41*a* are respectively provided in a position that overlaps with two corners 30 of one end (another nozzle row side) of each of the opening portions in the longitudinal direction and a position that overlaps with one corner 30 on the other end portion of each of the opening portions in the longitudinal direction. In the weight portions 41*a*, the total thickness of the portions in each of the piezoelectric elements 19 (entire thickness including the vibration plate 21, the lower electrode 27, the piezoelectric layer 28, the upper electrode 29, and the weight portion 41*a*, which configure each of the piezoelectric elements 19) is relatively thicker than the total thickness of the portions corresponding to each of the opening portions of the pressure chambers 22. Further, the weight portions 41*a* control the displacement of both ends of each of the active portions of the piezoelectric elements 19 in the longitudinal direction, thereby suppressing the irregular displacement of the piezoelectric elements 19 when the piezoelectric elements 19 are driven. In particular, similar to the pressure chambers 22 of the embodiment, when each of the piezoelectric elements 19 includes the corners 30 in the end portions thereof in the longitudinal direction and at least any one of sides which configure the corners 30 is inclined in the direction in which the pressure chambers are disposed in parallel or the longitudinal direction of the pressure chambers, unintended directional deformation of both end portions of each of the piezoelectric elements 19 in the longitudinal direction due to the effect of the inclined side is suppressed.

Each of the lead electrode portions 41*b* is patterned in correspondence to the lower electrode 27 which is the individual electrode, and is formed such that at least a part thereof overlaps with the upper portion of each of the conductive portions 29*b*. The lead electrode portion 41*b* is electrically conducted to the lower electrode 27 through the through hole 42. Further, a driving voltage (driving pulse) is selectively applied to each of the piezoelectric elements 19 through the lead electrode portion 41*b*. The weight portion 41*a* and the lead electrode portion 41*b* are formed in the same process, and the respective upper surfaces thereof (surfaces) are aligned on the same surface. In addition, at least one of the lead electrode portions 41*b* is electrically conducted to the upper electrode 29 which is the common electrode, and functions as a common electrode terminal.

In an embodiment of the head unit 11 having the configuration discussed herein, the upper electrode 29 may be removed and a part of the piezoelectric layer 28 may be exposed in a region between the main body portion 29*a* of the upper electrode 29 and the conductive portion 29*b*, or in a region between the weight portion 41*a* and the lead electrode portion 41*b* (in a configuration which does not include the weight portion 41*a*, between the main body portion 29*a* of the upper electrode 29 and the lead electrode portion 41*b*). Hereinafter, the exposed portions of the piezoelectric layer 28 in which the upper electrode 29 and the metal layer 41 are not formed are called exposed portions 28*a*.

The sealing board 20, which includes an empty reception portion 32 capable of receiving the piezoelectric elements 19, is bonded to the upper surface of the actuator unit 14. The actuator unit 14 is on the opposite side of the lower surface bonded to the flow channel forming substrate 15. The sealing board 20 may be a hollow box-shaped member in which the empty reception portion 32 is open toward the lower surface side that is bonded to the actuator unit 14. The empty reception portion 32 may be a hollow that is formed from the lower surface side of the sealing board 20 toward the upper surface side thereof in the middle of the height direction of the sealing board 20. The inside measurement of the empty reception portion 32 in the nozzle row direction (direction in which the pressure chambers are disposed in parallel) is set to a size capable of receiving all of the piezoelectric elements 19 in the same row. In addition, the dimension of the empty reception portion 32 in a direction which is perpendicular to the nozzle row is set to be slightly larger than the dimension of each of the pressure chambers 22 in the same direction (longitudinal direction) and smaller than the dimension of the piezoelectric layer 28 in the same direction. In addition, as shown in FIG. 2, the sealing board 20 is provided with an empty liquid chamber portion 33 in a position that is separated from the empty reception portion 32 on the outer side of the longitudinal direction of each of the pressure chambers and in a region that corresponds to the communication opening portion 26 of the vibration plate 21 and the communication portion 23 of the flow channel forming substrate 15. The empty liquid chamber portion 33 is provided in a series along the direction in which the pressure chambers are disposed in parallel while passing through the sealing board 20 in the thickness direction, and communicates with the communication opening portion 26 and the communication portion 23 in a series as described above, thereby forming a reservoir that is a common ink chamber of each of the pressure chambers 22.

The empty reception portion 32 and the empty liquid chamber portion 33 are separated by a panel wall 34. The lower surface of the sealing board 20 which includes the lower end surface of the panel wall 34 is bonded to the upper surface of the actuator unit 14 through adhesive B as shown in FIG. 5. The adhesive B is formed of, for example, epoxy adhesive, and is transferred to and coated on the lower surface of the sealing board 20 in advance. When the sealing board 20 is bonded to the actuator unit 14, the lower end surface of the panel wall 34 is bonded to the weight portions 41*a* and the lead electrode portions 41*b* while straddling the exposed portions 28*a* as shown in FIGS. 4 and 5. In the same manner, the lower end surface of the sealing board 20 is bonded to the weight portion 41*a* that is provided on the other sides of the pressure chambers 22 in the longitudinal direction through the adhesive. As described above, the exposed portions 28*a* of the piezoelectric layer 28 that are exposed between the main body portion 29*a* of the upper electrode 29 or the weight portion 41*a* and the lead electrode portions 41*b* are covered by the adhesive B. As described above, the sealing board 20 is bonded to positions which correspond to the corners 30 of each of the pressure chambers 22 and portions which have a total thickness that is relatively thick by providing the weight portions 41*a*. Therefore, it is possible to suppress unnecessary displacement of the piezoelectric elements 19 other than the active portions, and thus suppress the damage, such as cracks, of the piezoelectric elements 19 is securely suppressed from being generated. In addition, the hollows 31 are not provided in portions to which the sealing board 20 is bonded and the piezoelectric layer 28 in those portions has a flat surface. Thus it is possible to bond the sealing board 20 in a stable state.

A method of manufacturing the head unit 11 will be described.

Figure 6A:
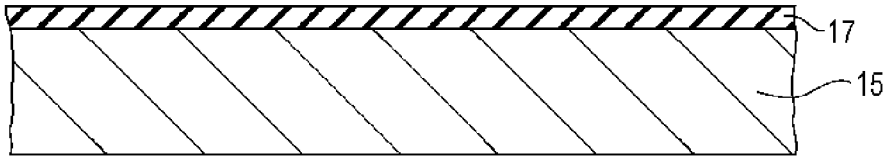
FIGS. 6A to 6E are cross-sectional views illustrating main portions of a process of manufacturing the head unit.
Figure 6B:
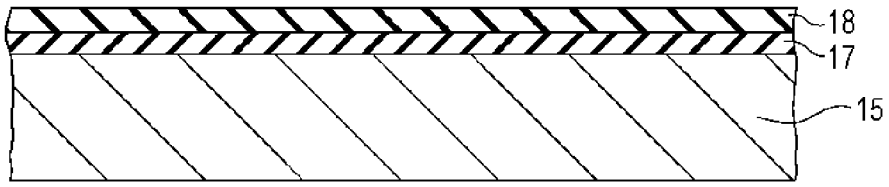
Figure 6C:
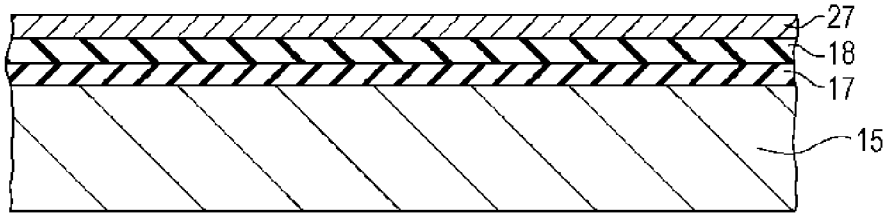

First, as shown in FIG. 6A, a silicon single crystal substrate that is the flow channel forming substrate 15 is thermally oxidized in a diffusion furnace at approximately 1100° C., and a silicon dioxide ($SiO_2$) film that configures the elastic film 17 is formed on the surface thereof. Subsequently, as shown in FIG. 6B, the insulation film 18, which is formed of zirconium oxide ($ZrO_2$), is formed on the elastic film 17. More specifically, first, a zirconium layer is formed on the elastic film 17 using, for example, a DC sputtering method, and the insulation film 18, which is formed of zirconium oxide, is formed in such a way that the zirconium layer is thermally oxidized. Subsequently, as shown in FIG. 6C, the lower electrode 27 is formed by laminating, for example, platinum (pt) and iridium (Ir) on the insulation film 18. The lower electrode 27 is patterned so as to have a width that is smaller than the width of the pressure chamber 22.

Figure 6D:
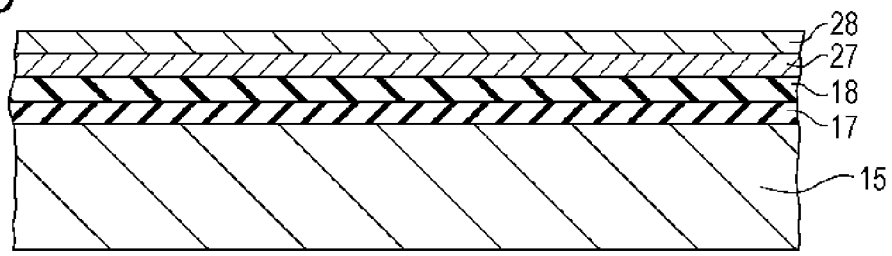
Figure 6E:
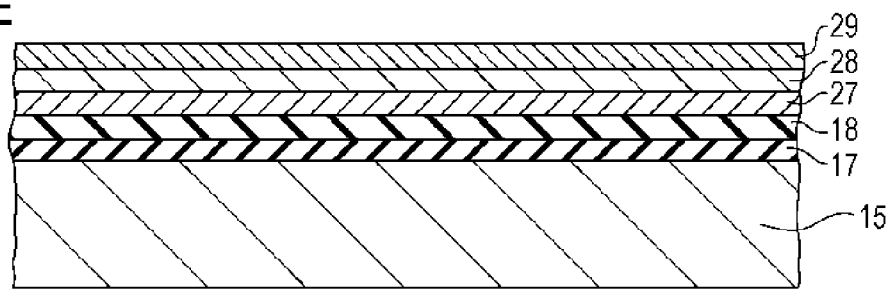

Subsequently, as shown in FIG. 6D, the piezoelectric layer 28, which is formed of lead zirconate titanate (PZT), is laminated on the surface of the lower electrode 27. In one embodiment, as a method of forming the piezoelectric layer 28, a so-called sol-gel method is used to form the piezoelectric layer 28 by gelling a so-called sol in which a metal organic material is dissolved and scattered in a solvent through coating and drying and by baking the sol at a high temperature. The method of forming the piezoelectric layer 28 is not particularly limited. For example, a MOD method, a sputtering method, or the like can be used. Subsequently, as shown in FIG. 6E, the upper electrode 29, which is formed of, for example, iridium, is formed on the upper surface of the piezoelectric layer 28 using a sputtering method or the like. The upper electrode 29 may be patterned into the main body portion 29*a* and the conductive portion 29*b*.

Figure 7A:
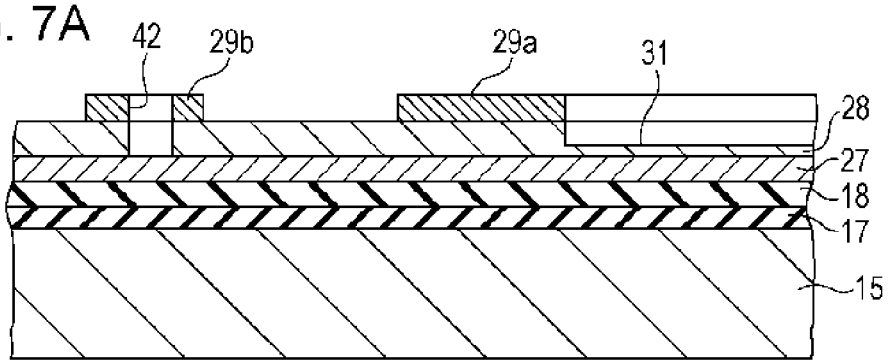
FIGS. 7A to 7C are cross-sectional views illustrating the main portions of the process of manufacturing the head unit.
Figure 7B:
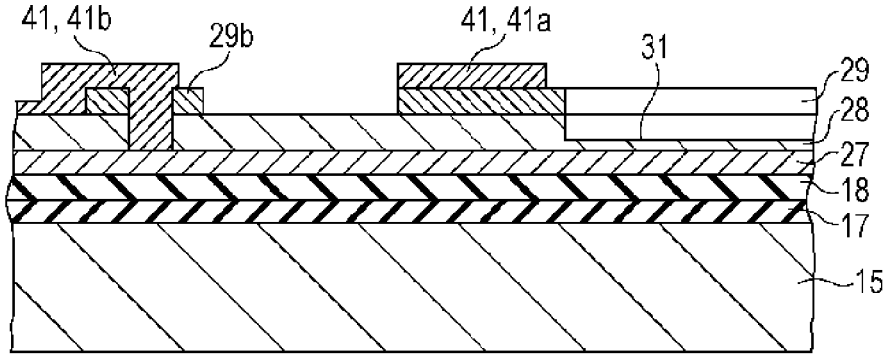
Figure 7C:
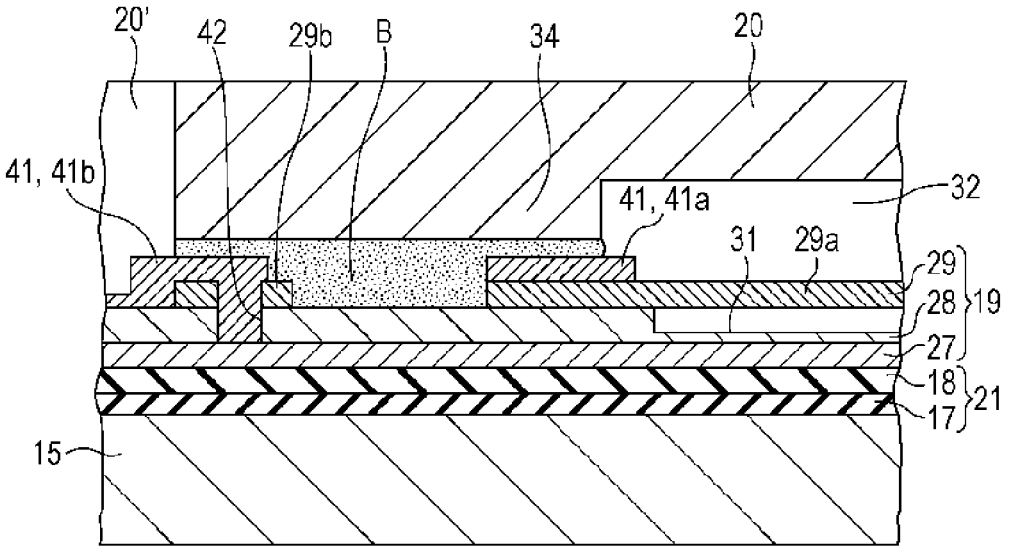

Subsequently, as shown in FIG. 7A, the piezoelectric layer 28 and the upper electrode 29 are patterned using dry etching, for example, reactive ion etching, ion milling, or the like. More specifically, the upper electrode 29 is patterned into the main body portion 29*a* and the conductive portion 29*b*. Further, the hollow 31 and the through hole 42 are formed in the upper electrode 29 and the piezoelectric layer 28. Subsequently, as shown in FIG. 7B, the metal layer 41 is formed on the upper electrode 29 through an adhesion layer which is not shown in the drawing using a sputtering method, a vacuum evaporation method, a CVD method or the like. The metal layer 41 is patterned into the weight portion 41*a* and the lead electrode portion 41*b* by etching or the like. Subsequently, the sealing board 20 is bonded to the actuator unit 14. As described above, when the sealing board 20 is bonded to the actuator unit 14, the lower end surface of the panel wall 34 is bonded to the weight portion 41*a* and the lead electrode portion 41*b* while straddling the exposed portions 28*a* of the piezoelectric layer 28. Therefore, the exposed portion 28*a* of the piezoelectric layer 28 is covered by the sealing board 20 and the adhesive B. Thereafter, in a state in which the actuator unit 14 and the sealing board 20 are covered by a protective sheet which is not shown in the drawing, the head unit 11, acquired in a state before the pressure chamber 22 is formed, is soaked by etching liquid, and the flow channel, such as the pressure chamber 22 or the ink supply path 24, is formed by etching on the flow channel forming substrate 15. If the flow channel, such as the pressure chamber 22, is formed, a process of bonding the nozzle plate 16 to the flow channel forming substrate 15 is performed (refer to FIG. 5).

In one example, a configuration in which the opening shape of the pressure chamber 22 is approximately a parallelogram is exemplified. However, embodiments of the invention are not limited thereto. In brief, it is possible to apply embodiments of the invention to a configuration that includes a pressure chamber that has a polygonal opening shape having a plurality of corners.

Figure 8:
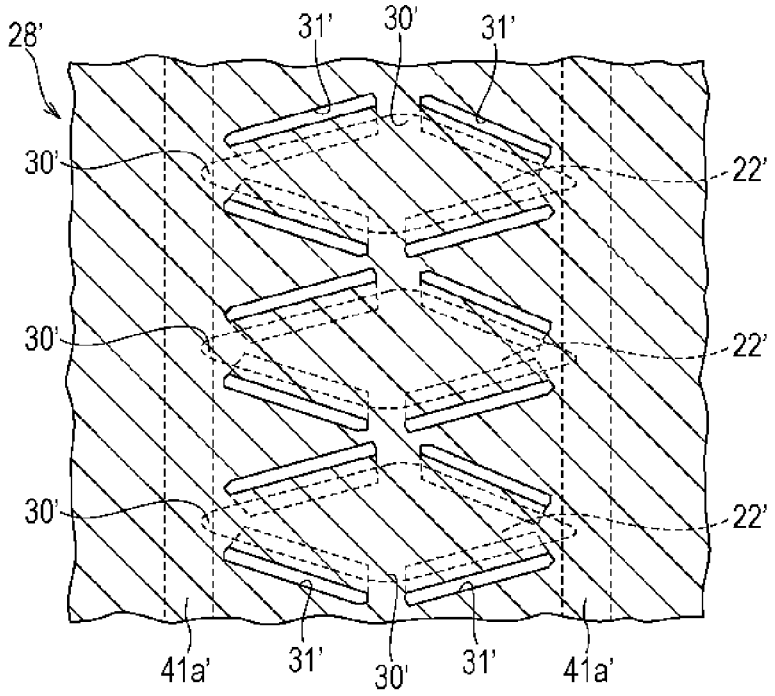
FIG. 8 is a plan view illustrating another example of a configuration of a piezoelectric layer.

FIG. 8 is a plan view illustrating a piezoelectric layer 28'. Meanwhile, for convenience, unnecessary configurations will not be described. In one embodiment, the opening shapes of the pressure chambers 22' (shown by dotted lines in FIG. 8) approximate diamond shapes, and adjacent pressure chambers 22' are disposed. The corner 30' of the pressure chambers 22' face each other. Unlike the corners 30, the corners 30' are different from corners that are acquired in such a way that a straight line intersects a straight line, and are configured to include curved lines that have predetermined curvature. Further, in the portion of the piezoelectric layer 28' that corresponds to regions between the adjacent pressure chambers 22, hollows 31' are formed along the respective sides in regions that are interposed between the sides of the pressure chambers 22'. More specifically, the hollows 31' are formed along the respective sides such that the hollows correspond to substantially straight sides of the opening portions of the respective pressure chambers 22'. That is, with regard to a single pressure chamber 22', a total of four hollows 31' are arranged to surround the opening portion of the pressure chamber 22'. The entire length of each hollow 31' is shorter than the length of a corresponding side of the pressure chamber 22'. In one embodiment, a region acquired along the corners 30' is relatively thicker than the thickness of the piezoelectric layer 28' in the hollows 31'. That is, a region, which includes at least one side in which the corner 30' is located and that is interposed between the adjacent pressure chambers 22', is relatively thicker than the thickness of the piezoelectric layer 28' in the hollows 31. In the configuration of one embodiment, it is possible to smoothly displace the piezoelectric layer 28', and it is possible to suppress displacement of unnecessary portions of the piezoelectric layer 28 to be driven. In addition, weight portions 41*a'* are respectively provided in positions that overlap with the corners 30' that are located in both end portions of the opening portion of the pressure chamber 22' in the longitudinal direction. When the weight portions 41*a'* are provided, the total thickness of the portions is relatively thicker than the total thickness of other portions. Thus it is possible to suppress the irregular displacement of the piezoelectric elements 19 when the piezoelectric elements 19 are driven. With regard to the hollow 31', it is possible to use a configuration in which a part of the hollows 31' overlap with the opening portion of the pressure chamber 22' as shown by broken lines in FIG. 8.

Figure 9:
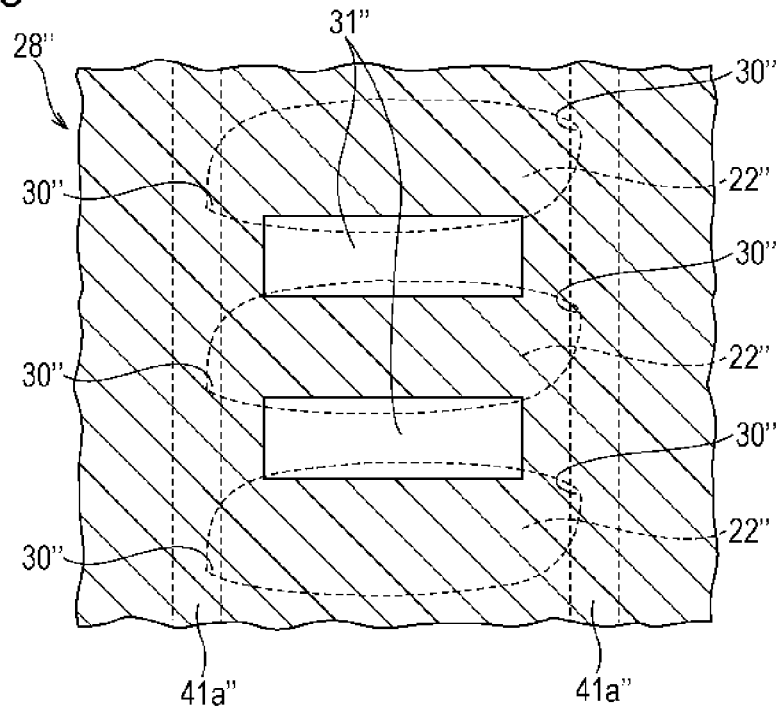
FIG. 9 is a plan view illustrating another example of a configuration of a piezoelectric layer.

FIG. 9 is a plan view illustrating a piezoelectric layer 28". In one embodiment, the opening shape of a pressure chamber 22" (shown by dotted lines in FIG. 9) is an approximately parallelogram shape that is configured to mainly have a gentle curved line. In the opening shape that is configured to have such a curved line, portions which have the maximum curvature and a second maximum curvature compared to other portions are defined as corners 30", and the other portions that have relatively smooth curved lines are defined as sides. Further, in a region of the piezoelectric layer 28" that corresponds to a region between adjacent pressure chambers 22", a hollow 31" is formed in a region that is interposed between the sides of the respective pressure chambers 22" along the sides. In one embodiment, the width of the hollow 31" is set to be slightly larger than walls that perform division on or that divide the pressure chambers 22", and the portions of the hollow 31" overlap with the opening portions of the respective pressure chamber 22". In addition, the entire length of each hollow 31" is shorter than the length of the corresponding sides. Therefore, similar to other embodiments, a region acquired along the corners 30" is relatively thicker than the thickness of the piezoelectric layer 28" in the hollows 31". That is, a region, which includes at least one side in which the corner 30" is located and that is interposed between the adjacent pressure chambers 22", is relatively thicker than the thickness of the piezoelectric layer 28" in the hollows 31". In the configuration of one embodiment, it is possible to smoothly displace the piezoelectric layer 28", and it is possible to suppress displacement of unnecessary portions of the piezoelectric layer 28" to be driven. In addition, weight portions 41*a*" are respectively provided in positions that overlap with the corners 30" that are located in both end portions of the opening portion of the pressure chamber 22" in the longitudinal direction and that have the maximum curvature. When the weight portions 41*a*" are provided, the total thickness of the portions is relatively thicker than the total thickness of other portions. Thus it is possible to suppress the irregular displacement of the piezoelectric elements 19 when the piezoelectric elements 19 are driven.

Embodiments of the invention are not limited to the above-described embodiments. In addition, in the above-described embodiments, an ink jet type recording head that is mounted on an ink jet printer is exemplified. However, if piezoelectric elements having such a configuration are used, it is possible to apply embodiments of the invention to a device that ejects liquid other than ink. For example, it is possible to apply embodiments of the invention to a color material ejecting head that is used to manufacture color filters of a liquid crystal display or the like, an electrode material ejecting head which is used to form electrodes of an organic Electro Luminescence (EL) display, a Field Emission Display (FED), or the like, a bio organic substance ejecting head that is used to manufacture a biochip, and the like.

What is claimed is:

1. A liquid ejecting head comprising:

a pressure chamber forming member that is formed with pressure chambers that communicate with nozzles; and a piezoelectric element that includes a first electrode, a piezoelectric layer, and a second electrode that are laminated in a position corresponding to an opening portion of each of the pressure chambers in the pressure chamber forming member in a sequence from a side close to the opening portion, wherein the first electrode is disposed on top of a vibration plate of the liquid ejecting head, the piezoelectric layer is disposed on top of the first electrode, and the second electrode is disposed on top of the piezoelectric layer, wherein the opening portion of each of the pressure chambers has a polygonal shape that includes a plurality of corners and sides that connect the corners to each other, and wherein the piezoelectric layer is integrally formed throughout the plurality of pressure chambers in the pressure chamber forming member, wherein a region along the sides from among regions that are interposed between adjacent pressure chambers includes a hollow that penetrates the piezoelectric layer or a hollow where a portion of the piezoelectric layer has been removed such that a thickness of the piezoelectric layer in the hollow is less than a thickness of the portion of the piezoelectric layer that is not part of the hollow, and wherein a region along the corners is thicker than the portion of the piezoelectric layer in the hollow.

2. A liquid ejecting head comprising:

a pressure chamber forming member that is formed with pressure chambers that communicate with nozzles; and a piezoelectric element that includes a first electrode, a piezoelectric layer, and a second electrode that are laminated in a position corresponding to an opening portion of each of the pressure chambers in the pressure chamber forming member in a sequence from a side close to the opening portion, wherein the first electrode is disposed on top of a vibration plate of the liquid ejecting head, the piezoelectric layer is disposed on top of the first electrode, and the second electrode is disposed on top of the piezoelectric layer, wherein the opening portion of each of the pressure chambers includes a polygonal shape which includes a plurality of corners and sides that connect the corners to each other, wherein the piezoelectric layer is integrally formed throughout the plurality of pressure chambers in the pressure chamber forming member, wherein a region that is interposed between sides from among regions that are interposed between adjacent pressure chambers includes a hollow that penetrates the piezoelectric layer or a hollow where a portion of the piezoelectric layer has been removed such that a thickness of the piezoelectric layer in the hollow is less than a thickness of the portion of the piezoelectric layer that is not part of the hollow, and wherein a region, that is interposed in such a way that the corners are positioned on at least one side, is thicker than the portion of the piezoelectric layer in the hollow.

3. The liquid ejecting head according to claim 1, wherein, in a position that is a region interposed between adjacent hollows and that corresponds to the opening portion of each of the pressure chambers, the piezoelectric layer that is thicker than thickness of the piezoelectric layer in the hollows is provided, and wherein a width of the piezoelectric layer in the position in a direction in which the pressure chambers are disposed in parallel is narrower than a width of the opening portion of each of the pressure chambers in a same direction.

4. The liquid ejecting head according to claim 1, wherein, on the piezoelectric layer that is positioned on both sides of the opening portion of each of the pressure chambers in a direction intersecting a direction in which the pressure chambers are disposed in parallel and that covers at least one corner, a laminated material that causes a total thickness of the part to be thicker than other parts is provided.

5. The liquid ejecting head according to claim 4, wherein the laminated material includes a metal film, and is formed in a series along a first direction in order to electrically conduct to the second electrode of the plurality of piezoelectric elements.

6. The liquid ejecting head according to claim 4, further comprising:

a sealing member that includes an empty portion inside, which is capable of receiving an active portion in which the first electrode, the piezoelectric layer, and the second electrode are superimposed on each other, wherein the sealing member is bonded to the laminated material in a state in which the active portion is received in the empty portion.

7. A liquid ejecting apparatus comprising the liquid ejecting head according to claim 1.

8. A liquid ejecting apparatus comprising the liquid ejecting head according to claim 2.

9. A liquid ejecting apparatus comprising the liquid ejecting head according to claim 3.

10. A liquid ejecting apparatus comprising the liquid ejecting head according to claim 4.

11. A liquid ejecting apparatus comprising the liquid ejecting head according to claim 5.

12. A liquid ejecting apparatus comprising the liquid ejecting head according to claim 6.

* * * * *